United States Patent [19]

Rockwell

[11] 4,131,056

[45] Dec. 26, 1978

[54] PILOT CONTROLLED VARIABLE DISPLACEMENT FLUID MOTOR

[75] Inventor: Harvey W. Rockwell, Springfield, Ill.

[73] Assignee: Fiat-Allis Construction Machinery, Inc., Deerfield, Ill.

[21] Appl. No.: 860,989

[22] Filed: Dec. 15, 1977

[51] Int. Cl.[2] ..... F01B 1/06

[52] U.S. Cl. ..... 91/492; 91/498

[58] Field of Search ..... 91/492, 493, 498, 491

[56] References Cited

U.S. PATENT DOCUMENTS

| | | | |
|---|---|---|---|
| 3,339,460 | 9/1967 | Birdwell | 91/491 |
| 3,357,362 | 12/1967 | Orr | 91/492 X |
| 3,899,958 | 8/1975 | Spencer | 91/498 |

*Primary Examiner*—Edgar W. Geoghegan

*Attorney, Agent, or Firm*—August E. Roehrig, Jr.; Robert A. Brown

[57] ABSTRACT

A pilot controlled variable displacement fluid motor is disclosed wherein fluid under pressure, received from a fluid pressure source such as a closed-center type system, is convertible selectively into bi-directional rotary motion at infinitely variably controlled speeds and torques. The motor is further characterized in that a change in the positional relationship of an arcuately movable control input member with relation to the position of an arcuately movable power output member, in combination with power transfer means, is effective for adjusting the power output speed to that of the control input member. Furthermore, the torque output is automatically adjusted to the load demand, whereby only the quantity of fluid, required to satisfy the speed selection and the torque demand, at a predetermined pressure level, is used by the motor.

12 Claims, 3 Drawing Figures

PILOT CONTROLLED VARIABLE DISPLACEMENT FLUID MOTOR

CROSS REFERENCE TO RELATED APPLICATION

Reference is made to my co-pending application Ser. No. 820,550 filed Aug. 1, 1977, assigned to the assignee of this invention, wherein is disclosed a similar fluid motor adapted for use in a hydraulic drive and control system comprising a motor control which is modified in response to hydraulic system pressure.

BACKGROUND OF THE INVENTION

This invention relates generally to conversion of the forces of fluid flowing under pressure into rotary motion, the speed and torque of which are infinitely variable. More particularly, but not exclusively, this invention relates to hydrostatic power transmission in which fluid under pressure is received from a source, such as a closed-center type of hydraulic system, a pilot controlled variable displacement fluid motor, in which the motor output direction and speed is responsive to the relative rotational direction and speed of a control element, and wherein torque output capability is automatically adjusted to torque demand. The invention is particularly adaptable to power transmission applications in which precise but variable control of speed and torque is desired. For example, heavy duty machinery has requirements for such power transmission systems for operating cable winches, propelling vehicles and driving rotating components.

Hydrostatic motors having integral speed reduction/-torque multiplying characteristics in the area of medium to light duty are frequently adapted for powering various mechanisms which may be located remotely from a power source. Such devices may be of the fixed displacement type and include orbital movement reduction gearing. An example of a motor of this type, which also includes a cylinder block having a radial piston configuration, is disclosed in U.S. Pat. No. 3,339,460. This type of motor has no provision for varying the piston displacement for the purpose of altering the direction of rotation or the speed and torque output. The direction of rotation is sometimes controlled by a manually operated 4-way valve. In some hydrostatic power applications it is the practice to use a variable displacement, reversible flow pump as the fluid pressure source, and to control the pump flow output in such a manner as to provide a corresponding direction of motor rotation and speed output. Since such a motor is of the fixed displacement type, the torque output capability is constant. A low torque requirement for a given speed setting results in a reduced fluid pressure volume being delivered by the pump, thereby eliminating the fluid pressure source for possible use in performing other functions.

Other hydrostatic motors are of the variable displacement type in which a control may be adjusted to a specific speed and torque capability setting. The fluid pressure source may be either a fixed displacement or a variable displacement pump. In the case of the latter, the usual practice is to mechanically coordinate the pump and motor controls. In the case of the former, the pump pressure varies according to the torque demand on the motor at any given speed setting; sometimes, relatively complex flow control and sequence valves are used in an attempt to control hydraulic conditions within the system. It is apparent, therefore, that in any of the prior art referred to, the fluid pressure source is primarily limited to a single function.

In view of the need for improved fluid motors, transmissions and controls, it is an object of the invention to provide an improved fluid motor and drive unit.

It is another object of this invention to provide a fluid motor having a configuration which uses fluid from a closed-center type or other fluid pressure source at a predetermined pressure level.

Another object is to provide a fluid motor which has integral gear reduction for use in applications wherein the driven member is a low speed, high torque member.

A further object is to provide a variable displacement fluid motor having pilot or follow-up control in which motor speed output is responsive to control speed input and wherein torque output is automatically adjusted to torque demand.

It is another object to provide an improved fluid motor in which static, dynamic, and pressure balance is achieved under all contemplated operating conditions to a substantial degree.

Still another object of this invention is to provide a fluid motor adaptable to various modes of control input.

It is a further object to provide a fluid motor having commonality of component parts thereby favorably influencing production and service costs.

Still another object is to provide a fluid motor which includes a control member which is movable between a plurality of positions and which, during movement between said positions, acts to vary the output torque and/or direction of the motor drive.

A still further object is to provide a fluid motor, transmission, and speed and torque control unit contained in a single housing.

Another object is to provide a fluid motor having means for varying the stroke of the pistons during operation so as to control the torque output of the motor, and having an operative connection between the power output member and the stroke control mechanism.

Another object is to provide a hydraulic motor and drive unit having improved fluid flow control means including means for insuring relatively smooth, shock-free operation of the motor even when the motor is operated under high fluid pressure.

Another object is to provide a fluid motor and transmission which is particularly adapted to operation in a closed loop or servomechanism mode of operation.

A still further object is to provide a motor and variable speed drive which is capable of delivering significant power but which is very compact in size.

These and other objects are attained in accordance with the present invention wherein there is provided a pilot controlled variable displacement fluid motor of the reciprocating piston type having a cylinder block co-axially and rotatably associated with relation to a motor frame which is rotatable to its support housing. Planetary or other reduction gearing drivingly joins the cylinder block, the motor frame, and the support housing, for maintaining a predetermined rotational relationship therebetween. The integral planetary gearing provides a torque multiplication between the cylinder block, which is the driving element, and the motor frame, which is the motor output or driven element. The planetary gearing system adapts the motor to accommodate a follow-up type of pilot control mechanism. The pilot control mechanism includes portions which are rotatably associated with the motor frame and the mechanism is adjustable for controlling the direction of rotation, the speed, and the torque output, of the motor by varying the piston stroke, or displacement, in response to a desired speed control input and a torque output demand upon receiving fluid from a fluid pressure source at a predetermined, substantially constant pressure level, such as from a closed-center type hydraulic system.

Further objects of the invention, together with additional features contributing thereto, the advantages accruing therefrom, and the manner in which they are attained, will become more apparent from the following detailed description of a preferred embodiment of the invention set forth by way of example and shown in the accompanying drawings wherein like numerals indicate corresponding parts throughout wherein:

DESCRIPTION OF THE PREFERRED EMBODIMENT OF THE INVENTION

Figure 1:
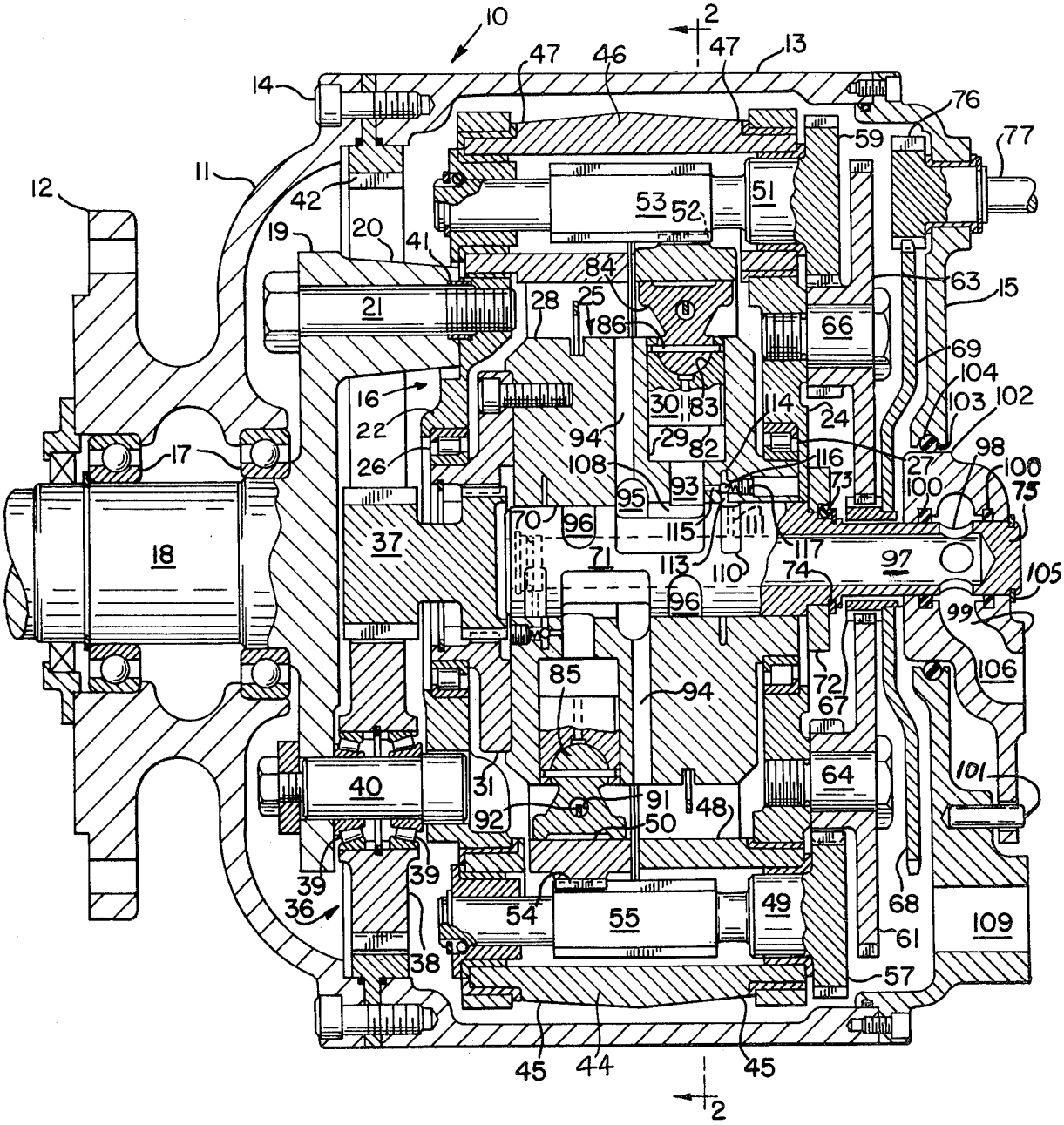
FIG. 1 is a vertical sectional view of a preferred form of motor and transmission unit of the invention, showing a support housing, a rotatable motor frame, a piston and cylinder assembly, planetary gearing in driving relationship therewith, and an axially positioned valve core about which the piston and cylinder assembly rotates, and further showing certain details of a variable position piston slipper raceway and control mechanism therefor.

Referring to FIG. 1, a preferred embodiment of the present invention is shown in which a pilot controlled variable displacement fluid motor includes a stationary housing assembly generally identified by the numeral 10. The housing assembly 10 comprises a journal casing 11 having a mounting flange 12, a generally cylindrical body member 13, fixedly attached to the journal casing 11 as by body capscrews 14, and a housing axial end cover 15 attached to the body member 13. A motor frame generally identified by the numeral 16 is rotatably supported by the housing 10 on journal bearings 17 contained on an inner diameter of the journal casing 11. The journal bearings are positioned on an output shaft 18 on which a spider (or planet carrier) flange 19 is formed. The spider flange 19 has a plurality of spider bosses 20, preferably three in number, formed thereon through which frame capscrews 21 extend to secure an axially positioned inner frame member 22 to the spider flange 19. The inner frame member 22 has a pair of extension members 23 in arcuate shape formed thereon, shown in FIG. 2 only, which are used to fixedly attach an axially spaced apart outer frame member 24, whereby bored holes therein are aligned with correspondingly bored holes in the inner frame member 22.

In addition to the two major components, namely, the stationary housing assembly 10 and the rotatable motor frame 16, the motor includes a third component, namely, a cylinder block and piston assembly 25. The construction of this unit and its relationship to the named two major components is basic to the operation of the motor, as hereinafter described.

The cylinder block and piston assembly 25 is shown to be rotatably supported centrally within the motor frame 16 on an axially-spaced inner bearing 26 at the inner frame member 22 an axially-spaced outer bearing 27 at the outer frame member 24. The outer bearing 27 is mounted on a reduced diameter hub formed on a cylinder block 28. The cylinder block 28 has two banks of axially spaced apart, radially extending cylinder bores 29, each of which receives a corresponding radially reciprocating piston assembly 30. A driving hub 31 is removably fastened to the cylinder block 28 and has the inner bearing 26 mounted thereon.

It should be emphasized now that the cylinder block and piston assembly 25 is rotatable co-axially with relation to the motor frame 16, which also is rotatable with relation to the stationary housing 10. A predetermined rotational ratio relationship between the aforesaid components 25, 16 and 10, is provided by means of planetary gearing generally identified by the numeral 36. Input to the planetary gearing is a sun gear 37 which is driven through splined engagement means by driving hub 31 of the cylinder block and piston assembly 25. A plurality of planet pinions 38, preferably three in number, meshing with the sun gear 37, are carried by pinion bearings 39 on pinion axles 40. The pinion axles 40 are supported on one end by bored holes in the inner frame member 22 and on the other end by the spider flange 19 of the output shaft 18. This combination along with the frame capscrews 21 and dowel sleeves 41, provide piloted alignment of the spider flange 19 and the inner frame member 22, thereby forming a planet pinion carrier element of the planetary gearing 36. A portion of the motor frame 16 is therefore, in effect, the planet pinion carrier and is the driven member of the planetary gearing 36. A ring gear 42 is fixed by capscrews 14 to the journal casing 11 and the gear is thus also fixed with respect to the cylindrical body member 13.

In the preferred embodiment, sun gear and pinion gear sizes have been selected in which an "apparent" gear reduction of 6.67 to 1 is provided between the cylinder block and piston assembly and the output shaft 18. The term "apparent" is used herewith because this reduction is a result of applying a generally accepted formula for calculating planetary gear reduction ratios, namely, the diameter of the ring gear 42 (fixed element) divided by the diameter of the sun gear 37 (driver element) plus one, equals the number of revolutions of the sun gear 37 (driver element) to one revolution of a planetary pinion carrier or the output shaft 18 (follower element). A "true" reduction, therefore, is 5.67 to 1 for calculating the torque multiplication and relative speed relationship between the cylinder block and piston assembly 25 and the motor frame 16. This is true because for each 6.67 revolutions of the driver element, the driver reaction member (follower element) rotates one revolution in the same direction. The result then is 6.67 minus 1 or 5.67 revolutions of the cylinder block and piston assembly 25 relative to the 1 revolution of the motor frame 16.

It will be understood that the modified planetary gearing function characteristic of the present invention is important for the purpose of providing follow-up or pilot control as will hereinafter be described.

As shown in FIG. 1, a pair of cam rings or piston slipper raceways 44 and 46 have pivot-receiving boss or offset hub portions 45 and 47 respectively formed thereon and internal cylindrical surfaces 48 and 50 surrounding the cylinder block and piston assembly 25 in abutting relation with the slipper portions of the piston assemblies 30. The hub portions 45 and 47 are shown to have sleeve bearing engaging extensions by which the piston raceways are pivotally mounted in the axially positioned inner and outer frame members 22 and 24 for oscillating motion therewith. The hub portions 45 and 47 have bored holes therein concentric with the sleeve bearing engaging surfaces for the purpose of receiving rack drive pinion gear members 49 and 51 rotatably therein. The hub portions 45 and 47 each have a radially inwardly facing aperture formed therein for providing assembly clearance with gear tooth racks 52 and 54 located on the diametrically opposite sides of the pair of piston slipper raceways 44 and 46 respectively. The gear tooth racks 52 and 54 are in driving engagement, through the apertures, with the rack drive pinion gear members 49 and 51, whereby rotation thereof imparts oscillating motion to the pair of piston slipper raceways 44 and 46 about their respective pivot points.

Figure 2:
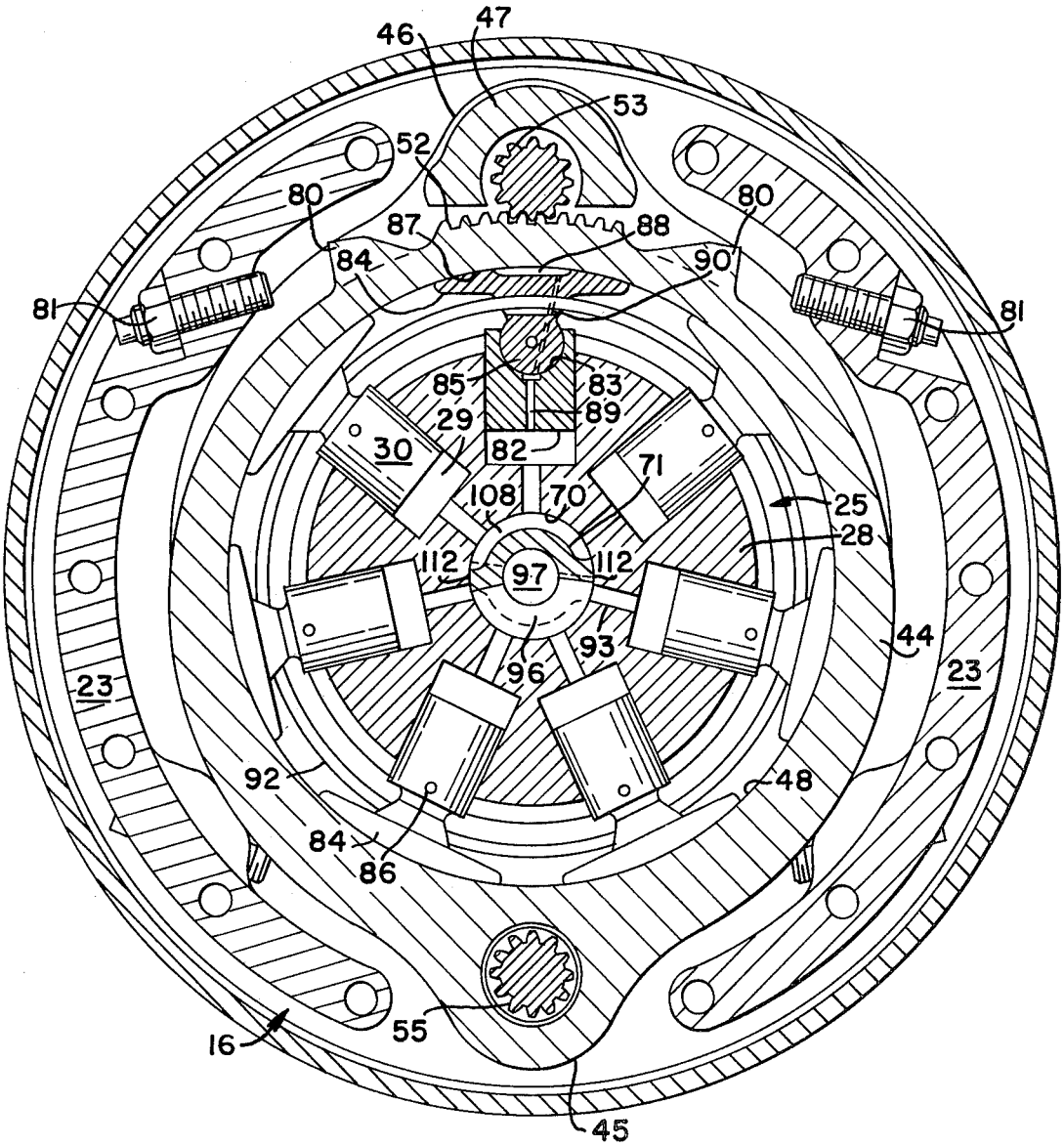
FIG. 2 is a vertical sectional view, taken along the lines 2—2 of FIG. 1, further illustrating the details of the piston and cylinder assembly, the piston slipper raceway in a null position concentric with the cylinder block and valve core, and showing a rack and pinion portion of the control mechanism indicating that the axis of the first pinion gear is co-axially disposed with respect to the pivot axis of the second piston slipper raceway, and vice versa.

It is noted that each piston slipper raceway is identical to the other of the pair and that they assemble in axially aligned fashion; each encircling its associated row of cylinders 29. FIG. 2 best illustrates the structural relationship of the pistons 30 and the cylinders 29, and shows the piston raceway 44, the hub portion 47, and the aperture thereof through which an actuating pinion 53 engages the gear tooth rack 52. The actuating pinion 55 for the raceway 46 is shown to be diametrically opposite from the counterpart actuating pinion 53 which positions the raceway 44.

Referring again to FIG. 1, it is shown that rack drive pinion gear members 49 and 51 have end gears 57 and 59 respectively formed therewith which are drivingly engaged by idler gear clusters 61 and 63 rotatable on stub axles 64 and 66 which are fixed, diametrically opposite of each other, to the outer frame member 24. The idler gear clusters 61 and 63 are drivingly engaged by a central pinion 67 of a control gear cluster 68 which also includes a control drive gear 69. The control gear cluster 68 is rotatable with relation to the motor frame in a manner to be described hereinafter.

With further reference to FIG. 1, the cylinder block 28 in addition to having two banks of radially positioned cylinders 29 contained therein, has an axially extending valve bore 70 for receiving a valve core 71 about which the cylinder block 28 rotates. Axial movement of the valve core 71 with relation to the motor frame 16 is prevented, but the valve core 71 and the motor frame 16 are permitted to rotate as a unit by means of an anchor member 72, a key ball 73, and an anchor snap ring 74 in combination with an anchor-to-frame fastening means, not shown. The preferred fastening means will allow slight radial freedom of motion to allow a radial floating relationship between the valve core 71 and the cylinder block 28. The valve core has a reduced diameter extension 75, projecting outwardly from the anchor member about which the control gear cluster 68 is allowed to rotate. The control gear 69 of the control gear cluster 68 drivingly engages a control input pinion 76 which has a bearing engaging portion thereon received for rotation in a bearing bore through the housing end cover 15 of the stationary housing 10.

The control input pinion 76 has a control shaft 77 extending externally of the housing 10 for providing rotary motion input to the motor control mechanism. It is to be understood that different applications of the motor may require different gear reduction ratios between the control shaft 77 and the simultaneously oscillated piston slipper raceways 44 and 46, depending upon the required control sensitivity and the method provided for control input, not disclosed herein. An example of an applicable control input is disclosed in the previously referred to co-pending application, namely, a chain drive connection between the positioner and a drive control manipulated by an operator.

Figure 3:
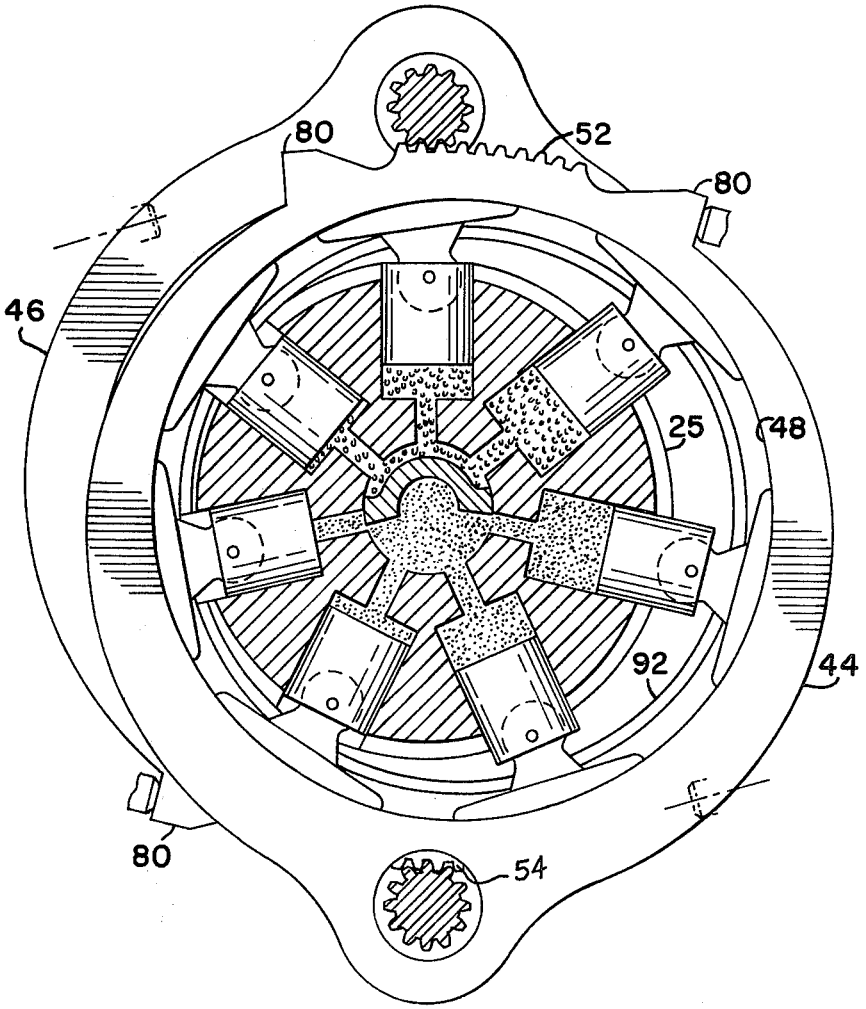
FIG. 3 is a vertical sectional view of certain portions of the motor of FIG. 2, showing the piston slipper raceway in a maximum offset or eccentric position.

It will be noted upon analyzing the control mechanism gearing that the piston raceways 44 and 46 are oscillated in an offsetting or opposing manner as may be seen with reference to FIG. 3. This provides balancing of the rotating members and also makes possible a substantial balancing of fluid pressure induced forces. The piston slipper raceways 44 and 46 are shown in FIG. 3 in fully pivoted positions or in positions of greatest offset or eccentricity with relation to the cylinder block and piston assembly 25. Stop means in the form of bosses 80 are shown (FIGS. 2 and 3) to be formed on the pairs of raceways 44 and 46, one for each direction of movement from the null or concentric position, thereby providing for forward or reverse direction of the motors. The stop bosses 80 engage corresponding adjustably positioned stop members 81 located in the extension members 23 of the motor frame 16.

In the preferred embodiment, the pair of raceways are shown as a type of cam ring, and the pistons and cylinders are shown to be radially positioned, but it is to be understood that a motor having parallel piston/cylinder arrangements and a swashplate type of piston raceway could be used with appropriate follow-up control of the swashplate position.

Referring now to FIGS. 1 and 2, particularly to the piston assemblies 30 shown therein, it will be seen that each piston assembly is comprised of a piston 82 have a semi-spherical socket 83 formed in the radially outer end thereof. A piston slipper 84 has a spherical ball end 85 thereon in precision fitting relation in the semi-spherical socket 83. A wrist pin 86 is used to relatively loosely retain the piston 82 and the piston slipper 84 in an assembled condition. The slipper 84 has an arcuate surface 87 sized for a precision mating and sliding relationship with the inwardly directed cylindrical surfaces 48 and 50 of the pair of piston raceways 44 and 46. Each piston slipper 84 has a fluid pressure compensating recess 88 which exposes an area on the cylindrical surfaces 48 and 50 to somewhat less fluid force than is exerted on the cross sectional area of the pistons 82. A connecting piston passage 89 and a slipper passage 90 formed in the pistons 82 and the slippers 84 respectively serve to transfer operating fluid pressure in the cylinders 29 to the recesses 88 for the purpose of reducing unit pressure contact between the arcuate surface 87 of the slippers 84 and the cylindrical surfaces 48, 50 of the pair of piston raceways 44, 46. Further, the fluid in passages 89 and 90 serves to lubricate the socket 83, the ball end 85, the arcuate surface 87, and the cylindrical surfaces 48 and 50. Each of the piston slippers 84 has a guide hole 91 formed therein spaced radially inwardly from and generally concentrically located with respect to the arcuate surface 87. The hole 91 receives a guide ring 92 which tends to bias the piston assemblies 30 radially outward for the purpose of providing initial fluid pressure seal contact between the slippers 84 and the cylindrical surfaces 48 and 50. Additionally, the guide ring 92 assures that the piston assemblies will move radially outward during conditions of so-called dynamic braking; in this mode of operation, the motor performs a pumping function, and fluid is drawn into the cylinders 29 and expelled in a reverse flow manner. Provision for normal motor function fluid flow, however, is as hereinafter defined.

Referring particularly to FIG. 1, and incidentally to FIGS. 2 and 3, it may be seen that the cylinder bores 29 in the cylinder block 28 are connected to the valve bore 70 by means of a plurality of radially disposed cylinder passages 93. The cylinder block 28 also has a plurality of radially disposed outlet passages 94 connecting the periphery thereof with an annular recess 95 formed in adjoining and concentric relationship with the valve bore 70. The valve core 71 is formed so as to have sets of recesses and passages, one set for each of the two banks of cylinders. An inlet passage 96 of each set provides fluid communication, during less than half of a revolution of the cylinder block 28, between each cylinder passage 93 and a central inlet passage 97 which is disposed centrally within the valve core 71. The passage 97 has radially outwardly directed openings 98 located at the reduced diameter extension 75 thereof. An inlet fitting 99 has a pair of liquid tight seals 100 axially spaced in annular grooves therein on either side of the openings 98 for sealing high pressure fluid during relative rotation between the motor frame 16 and the stationary housing 10; the inlet fitting 99 is anchored to the housing cover 15 with an anchor pin 101. The inlet fitting 99 is formed with a cylindrical seal surface 102 for low pressure fluid sealing engagement with an O-ring 103 of large cross section which is retained in a fitting seal groove 104. The inlet fitting 99 is axially retained in relation to the valve core by a fitting retainer snap ring 105. A supply fluid inlet port 106 in the fitting 99 conducts pressure fluid from a suitable fluid pressure source (not shown), which may be a so-called pressure compensated variable displacement pump such as defined in the previously mentioned co-pending application.

Again referring to the sets of recesses and passages formed in the valve core 71, it is noted that an axially elongated outlet recess 108 of a crescent shaped cross sectional configuration is formed in each set of passages and recesses. The outlet recess 108 provides a fluid return passage from the cylinder bores 29, through the cylinder passages 93, annular recess 95, outlet passages 94, to the interior of the housing 10, and through an outlet port 109 to the fluid supply system, not shown. It may also be seen that a relatively shallow balance recess 110 is provided, and that this recess 110 is disposed axially outwardly of, the outlet recess 108. A pressure transfer hole 111 extends between recess 110 and the central inlet passage 97. Radial fluid pressure balance of the valve core 71 is achieved by appropriately positioning, sizing and shaping the balance recesses 110 in relation to the inlet passages 96 in a manner known to those skilled in this art.

Referring to FIG. 2, it will be noted that the cross section portion of the valve core 71 appears to be rotationally tilted counter clockwise from what would seem a normal position. Similarly dotted lines representing the valve core 71 cross section in the plane of the other bank of cylinders and pistons is tilted clockwise from a seeingly normal position, thereby forming a staggered relation therebetween. It will also be noted that valve lands 112 on the periphery of the valve core 71 are formed by reason of the fact that the inlet passages 96 and outlet recesses 108 each occupy less than a semi-circular portion of the core periphery. These valve lands 112 function to perform so-called "cut-on" and "cut-off" of fluid inlet and outlet to the cylinders 29 when crossing of the lands 112 by the cylinder passages 93 during rotation of the cylinder block and piston assembly 25 with relation to the valve core 71. The purpose of the staggered positioning of the cross sections one with relation to the other is to provide the "cut-on" and "cut-off" functions so that no two cylinders are subjected to this action simultaneously. This increases the number, and decreases the severity of, the pulsations usually associated with fluid devices of this general character, and this feature constitutes an important advantage of the invention.

A further point concerning the lands 112 is that each is formed so as to have slightly greater arcuate dimension than the corresponding dimension of the cylinder passages 93. This practice is well known in the art to be used in order to increase operating efficiency by reducing pressure fluid loss when the passages 93 cross over the lands 112. At this cross-over point, particularly in combination with the staggering of the lands, fluid may be momentarily trapped in a cylinder 29 and the passage 93, creating extremely high momentary fluid pressure. This situation can be extremely detrimental for numerous reasons, including generation of excessive noise. A means of eliminating this drawback without decreasing motor efficiency is provided by incorporating so-called "spitter" check valves 113 between each of the passages 93 and an annular relief recess 114. A relief passage 115 connects the passage 93 with recess 114 which is normally closed by a ball check valve 116 biased to the closed position by a valve spring 117. It may be seen that the annular relief recess 114 is in pressure fluid communication with the balance recess 110, the pressure transfer hole 111, and the central inlet passage 97. Therefore, when cylinder passage 93 is exposed to high pressure trapped fluid, an escape is provided back to the normal high pressure fluid supply in the central inlet passage 97. Also, when the cylinder passage 93 is only exposed to low pressure return fluid the high pressure fluid in the central passage is prevented from entering the cylinder passage because of the presence of the ball check valve 116.

From the foregoing description it may be understood that, with the cam rings or piston slipper raceways in a neutral or concentric position with relation to the cylinder block, pressure fluid from a closed-center type fluid pressure source entering port 106 places the motor in a potentially operative condition. This is shown in FIGS. 1 and 2 wherein fluid pressure is translated from the port 106 through the radial openings 98, the central inlet passage 97 of the valve core 71 and radially outward into the two inlet passages 96, each associated with its bank of cylinders 29. FIG. 2 illustrates the condition of one bank in which the inlet passage 96 has fluid connection with four of the cylinders 29 in the bottom half of the cylinder block 28 through cylinder passages 93. Similarly, as shown in phantom lines, the other inlet passage in valve core 71 communicates with four of the cylinders 29 in the top half of the other bank. It is to be understood that the cylinders 29, preferably seven in number in each bank, are in peripherally staggered relation with the seven cylinders of the other bank. Since the pair of piston raceways 44 and 46 are shown concentrically positioned with the cylinder block and piston assembly 25, the radially outward thrust of the four piston assemblies 30 in each bank acts through the piston slippers 84 without any rotary motion force component.

With reference again to FIG. 1, rotation of the control shaft 77 in a selected direction will rotate the control input pinion 76 and the control gear cluster 68, of which the control pinion 67 is a part. Rotation of the control pinion 67 will simuultaneously rotate the idler gear clusters 61 and 63, which drive the pinion gear members 49 and 51 respectively. Inasmuch as actuating pinions 53 and 55 are parts of members 49 and 51 respectively, they will drive the gear tooth racks 52 and 54 respectively, thereby causing the piston raceways 44 and 46 to pivot or shift in opposite directions to each other and into eccentric relation with respect to the cylinder block and piston assembly 25. This condition is best illustrated in FIG. 3, wherein it is shown that a rotary force component has now developed between the cylinder block and piston assemblies and the raceways 44 and 46 which, as previously indicated, are carried by the motor frame 16. The planetary gearing 36, being operatively associated with the cylinder block and piston assembly 25 (drive member), the motor frame 16 (power output) and the stationary housing 10 (stationary member), is effective to transfer the rotary motion force components to the output shaft 18.

It will be understood that the position of the control gearing, which includes the control gear cluster 68 described above, with relation to the motor frame 16, is also operative if a change is initiated by the output shaft 18 in relative rotation with reference to the control shaft 77. This has the effect of adjusting the piston stroke, hence the torque output to match the torque demand and the speed output to match or be synchronized with the control input shaft speed.

It will thus be seen that the present invention provides a novel fluid motor having several advantages and characteristics including those apparent from the above description and others which are inherent in the invention. It is anticipated that changes and modifications to the described form of fluid motor will occur to those skilled in the art and that such changes and modifications may be made without departing from the spirit of the invention or the scope of the appended claims.

I claim:

1. A combination fluid motor and drive unit comprising, in combination, an exterior housing member, a power output member having a portion extending through a part of said housing and journalled for rotation relative to said housing, said drive member including means for supporting at least one output driven gear, at least one output driven gear received on a portion of said power output member and mounted for rotation relative thereto, an output drive gear having portions engaging said driven gear, means positioning said drive gear within said housing and supporting said drive gear for rotation relative to said housing, a cylinder block disposed within said housing and being supported for rotation with respect to said housing, a drive connection between said cylinder block and said drive gear, means engaging said driven gear to cause rotation of said power output member upon rotation of said driven gear, valve means associated with said cylinder block for directing fluid under pressure into said cylinders, a plurality of piston and slipper assemblies each having a portion received within one of the cylinders in said block, at least one torque reaction receiving ring surrounding said piston and cylinder units, said torque reaction receiving ring including an inwardly directed cylindrical raceway for said slipper assemblies, said ring being movable among a plurality of positions including positions of both offset and concentric disposition with respect to said cylinder block to change the torque and directional operating characteristics of said cylinder block, and control means for positioning said ring in a desired one of said plurality of positions.

2. A fluid motor and drive unit as defined in claim 1 in which said housing further includes a ring gear disposed about an interior surface thereof, said ring gear forming said means for engaging said driven gear to cause rotation of said power output member upon rotation of said driven gear.

3. A fluid motor and drive unit as defined in claim 1 wherein said means on said drive member for supporting said at least one output driven gear comprises means for supporting three driven gears, with one driven gear being received on each of said gear support means.

4. A fluid motor and drive unit as defined in claim 1 in which said control means for positioning said ring comprises a rotatable pinion gear and a rack forming a part of said ring, said pinion gear and said rack being disposed in operative engagement with each other.

5. A fluid motor and drive unit as defined in claim 1 in which said ring includes a toothed rack portion and in which said control means includes a control drive element and a pinion gear having portions adapted to engage said rack, said unit further including a reduction gear train for driving said pinion gear, whereby said ring undergoes relatively slight angular motion in respect to the angular motion undergone by said control drive element.

6. A fluid motor and drive unit as defined in claim 1 wherein said cylinder block comprises a block having at least two parallel rows of cylinders, said cylinders being radially disposed within each of said rows in said block, and said rows of cylinders being axially spaced apart from each other.

7. A fluid motor and drive unit as defined in claim 1 wherein said cylinder block includes two rows of cylinders, the cylinders in each row being disposed radially within said cylinder block, and said rows being spaced axially apart, and wherein one torque reaction receiving ring is provided for each row of cylinders.

8. A pilot controlled variable displacement fluid motor comprising a rotatable motor frame, a stationary housing for rotatingly supporting said frame, a cylinder block co-axially and rotatably carried by said frame, said cylinder block having a plurality of cylinder bores and fluid passages therein, planetary gearing means operatively connecting said frame, said housing and said cylinder block for maintaining a predetermined rotational ratio relationship therebetween, a plurality of pistons reciprocatingly disposed in said bores, a slipper associated with each piston, valve means for receiving fluid from a source of fluid under pressure and distributing said fluid to said cylinder bores and against one end of said pistons, means forming a raceway for said slippers, said raceway being pivotable about an axis which is non-concentric with respect to the center line of said cylinder block so that pivotal movement of said raceway means will vary the stroke of said pistons during rotary motion of said cylinder block, and control means operatively associated with said raceway means for pivoting said raceway means to control the direction of rotation, the speed, and the torque output of said motor.

9. A pilot controlled variable displacement fluid motor as defined in claim 8 wherein said cylinder bores are positioned radially in said cylinder block, and said raceway means is a ring having a radially inwardly directed cylindrical surface in abutting relation with said slippers.

10. A pilot controlled variable displacement fluid motor as defined in claim 8 wherein said planetary gearing means comprises a sun gear element operatively joined to said cylinder block, a planet pinion carrier element fixedly associated with said frame for unitary rotation therewith, and a ring gear element fixedly associated with said stationary housing.

11. A pilot controlled variable displacement fluid motor as defined in claim 8 wherein said valve means comprises a valve core extending axially through the rotational axis of said cylinder block, said valve core includes a high pressure fluid passage for directing high pressure fluid to some of said cylinder bores during one portion of a revolution of said cylinder block, and a low pressure passage for allowing low pressure fluid to be expelled from other of said cylinder bores during another portion of said cylinder block revolution.

12. A pilot controlled variable displacement fluid motor as defined in claim 11 wherein said cylinder block has two axially spaced banks of radially extending cylinder bores and fluid passages, and said raceway means is a pair of cylindrical rings each pivoted about a ring pivot axis therewith diametrically opposite and parallel to the other and substantially equidistant from and parallel to a centrally positioned axis of said frame, said cylinder block and said valve core, each of said pair of cylindrical rings being actuated by a pair of rack and pinion means associated with said control means and said pair of cylindrical rings, said pair of rack and pinion means being comprised of a pair of actuator pinions coaxially rotatable within hub portions of said cylindrical rings and engaging arcuate racks formed on a peripheral portion of said cylindrical rings diametrically opposite said ring pivot axis, said control means being operative to displace said pair of cylindrical rings in offset positions with respect to each other.

* * * * *